US010299569B1

(12) United States Patent
Taylor

(10) Patent No.: US 10,299,569 B1
(45) Date of Patent: May 28, 2019

(54) COSMETOLOGY TOOL STORAGE ASSEMBLY

(71) Applicant: Frank Taylor, Kent, WA (US)

(72) Inventor: Frank Taylor, Kent, WA (US)

( * ) Notice: Subject to any disclaimer, the term of this patent is extended or adjusted under 35 U.S.C. 154(b) by 0 days.

(21) Appl. No.: 16/005,482

(22) Filed: Jun. 11, 2018

(51) Int. Cl.

| | |
|---|---|
| ***A45D 44/02*** | (2006.01) |
| ***H01R 25/00*** | (2006.01) |
| ***A45D 44/06*** | (2006.01) |
| *B26B 19/38* | (2006.01) |
| *A45D 20/12* | (2006.01) |

(52) U.S. Cl.
CPC ..... *A45D 44/06* (2013.01); *H01R 25/006* (2013.01); *A45D 2020/126* (2013.01); *B26B 19/3833* (2013.01)

(58) Field of Classification Search
CPC ..... A45D 44/06; A45D 44/02; A45D 44/04
See application file for complete search history.

(56) References Cited

U.S. PATENT DOCUMENTS 508,596 A * 11/1893 Bisel ..... A47G 25/0685 211/96
698,795 A * 4/1902 Burns ..... A47G 25/0685 160/335
1,078,729 A * 11/1913 Hill ..... A47G 25/54 211/115
2,639,818 A * 5/1953 Wells ..... A47K 10/10 211/104
3,420,381 A * 1/1969 Bradfield ..... H05K 7/16 211/169
4,102,069 A * 7/1978 Eckert ..... A47F 5/02 211/169
4,159,773 A 7/1979 Losenno
5,038,946 A * 8/1991 Tenser ..... A47F 5/0093 206/554
5,143,231 A * 9/1992 Chang ..... A47B 61/003 211/168
5,379,903 A 1/1995 Smith
5,630,517 A * 5/1997 Maznik ..... A45D 20/12 211/70.6
5,794,799 A * 8/1998 Collins ..... A45D 1/20 211/60.1
5,806,693 A * 9/1998 Carbonaro ..... A47B 21/045 211/169
5,917,694 A * 6/1999 Denny ..... A45D 1/00 206/372
5,924,579 A 7/1999 DuPont
6,065,618 A * 5/2000 Stetler ..... A47B 61/003 211/168
6,331,121 B1 12/2001 Raeford
(Continued)

*Primary Examiner* — Kimberly S Wright

(57) ABSTRACT

A cosmetology tool storage assembly for storing and supplying electrical power for a plurality of cosmetology tools includes a gate that is pivotally coupled to a vertical support surface in a salon or the like. Thus, the gate is accessible to a cosmetologist working in the salon. A power strip is coupled to the gate and the power strip has a plurality of female electrical outlets positioned thereon. A plurality of hooks is included and each of the hooks is coupled to the gate. Each of the hooks engages and thusly suspends a respective one of a plurality of cosmetology tools for storage and each of the cosmetology tools can be plugged into a respective female electrical outlet.

1 Claim, 4 Drawing Sheets

(56) References Cited

U.S. PATENT DOCUMENTS

| | | | | |
|---|---|---|---|---|
| 6,581,890 | B2 * | 6/2003 | Johnson | A45D 44/04 248/161 |
| 6,769,554 | B1 * | 8/2004 | Udofiah | A45D 44/06 211/26.2 |
| 7,534,136 | B2 * | 5/2009 | Bova | H01R 13/60 248/317 |
| D608,945 | S | 1/2010 | Coleman | |
| 8,028,844 | B2 * | 10/2011 | Costa | A47G 25/746 211/104 |
| 8,544,623 | B1 | 10/2013 | Murphy | |
| D735,412 | S | 7/2015 | Coleman | |
| 9,254,050 | B1 * | 2/2016 | Bradbury | A47F 7/0064 |
| 9,949,554 | B2 * | 4/2018 | Sullivan | A47F 5/08 |
| 2011/0133572 | A1 * | 6/2011 | Levi | A45D 20/14 307/139 |
| 2016/0081458 | A1 * | 3/2016 | Sullivan | A47L 7/0066 361/679.01 |
| 2016/0294127 | A1 * | 10/2016 | Mouradian | H01R 13/72 |
| 2017/0215556 | A1 * | 8/2017 | Sullivan | A47F 5/08 |

* cited by examiner

COSMETOLOGY TOOL STORAGE ASSEMBLY

(b) CROSS-REFERENCE TO RELATED APPLICATIONS

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing and supplying electrical power to a plurality of cosmetology tools.

(h) BRIEF SUMMARY OF THE INVENTION

An embodiment of the disclosure meets the needs presented above by generally comprising a gate that is pivotally coupled to a vertical support surface in a salon or the like. Thus, the gate is accessible to a cosmetologist working in the salon. A power strip is coupled to the gate and the power strip has a plurality of female electrical outlets positioned thereon. A plurality of hooks is included and each of the hooks is coupled to the gate. Each of the hooks engages and thusly suspends a respective one of a plurality of cosmetology tools for storage and each of the cosmetology tools can be plugged into a respective female electrical outlet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
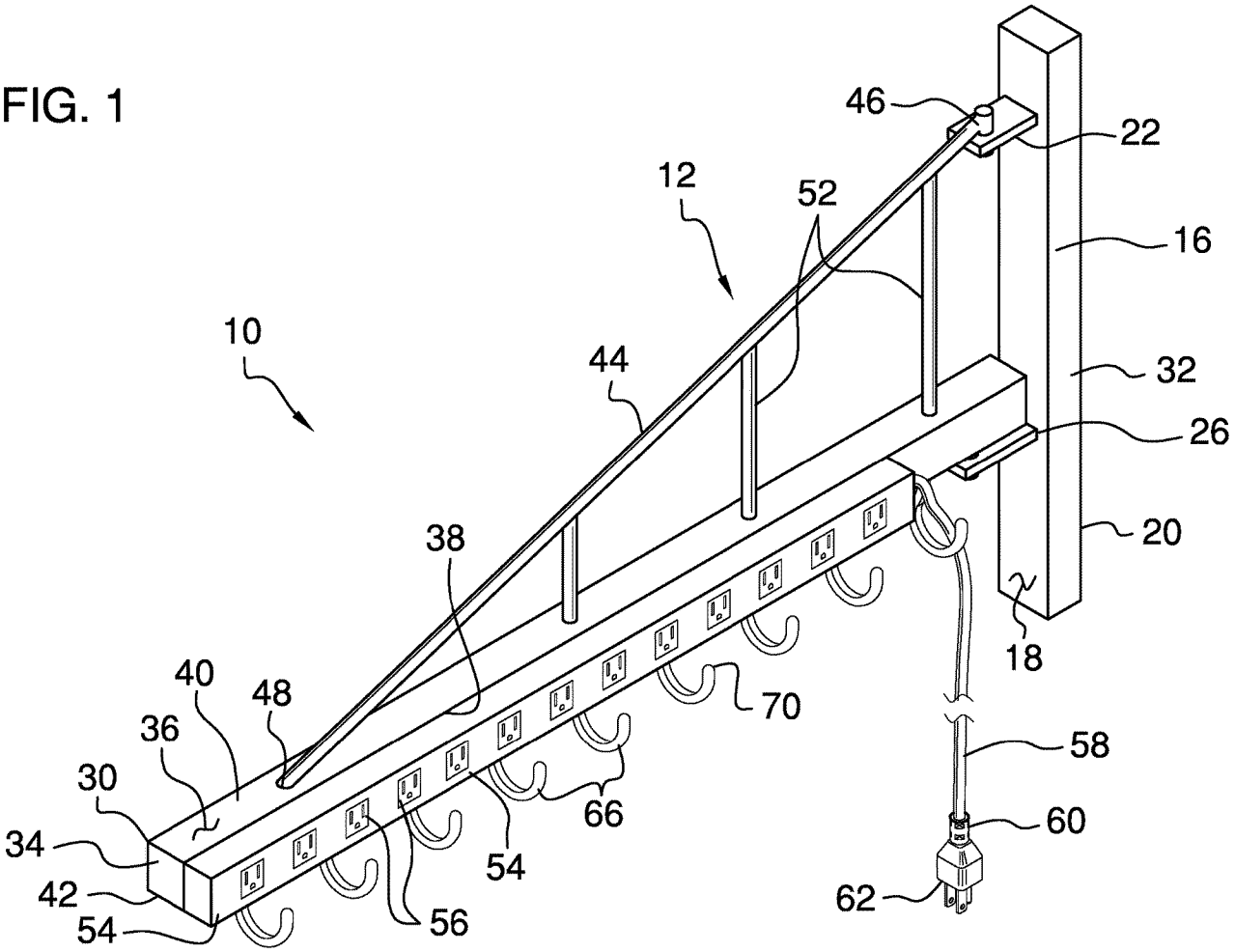
FIG. 1 is a perspective view of a cosmetology tool storage assembly according to an embodiment of the disclosure.
Figure 2:
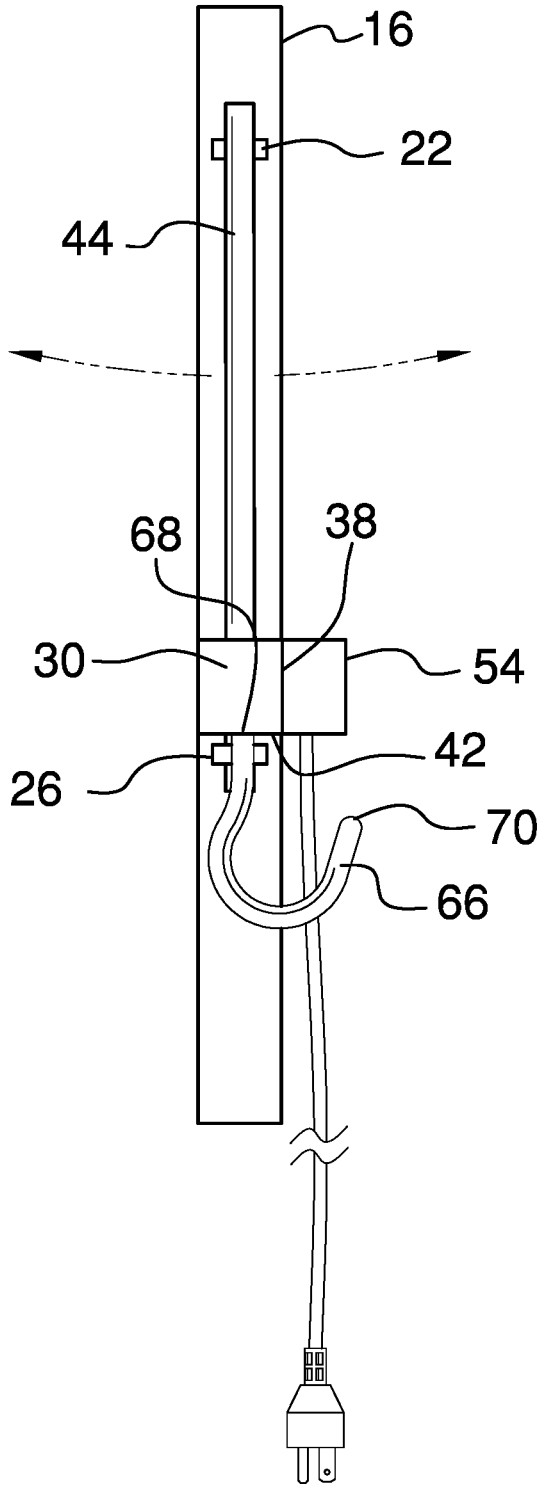
FIG. 2 is a front view of an embodiment of the disclosure.
Figure 3:
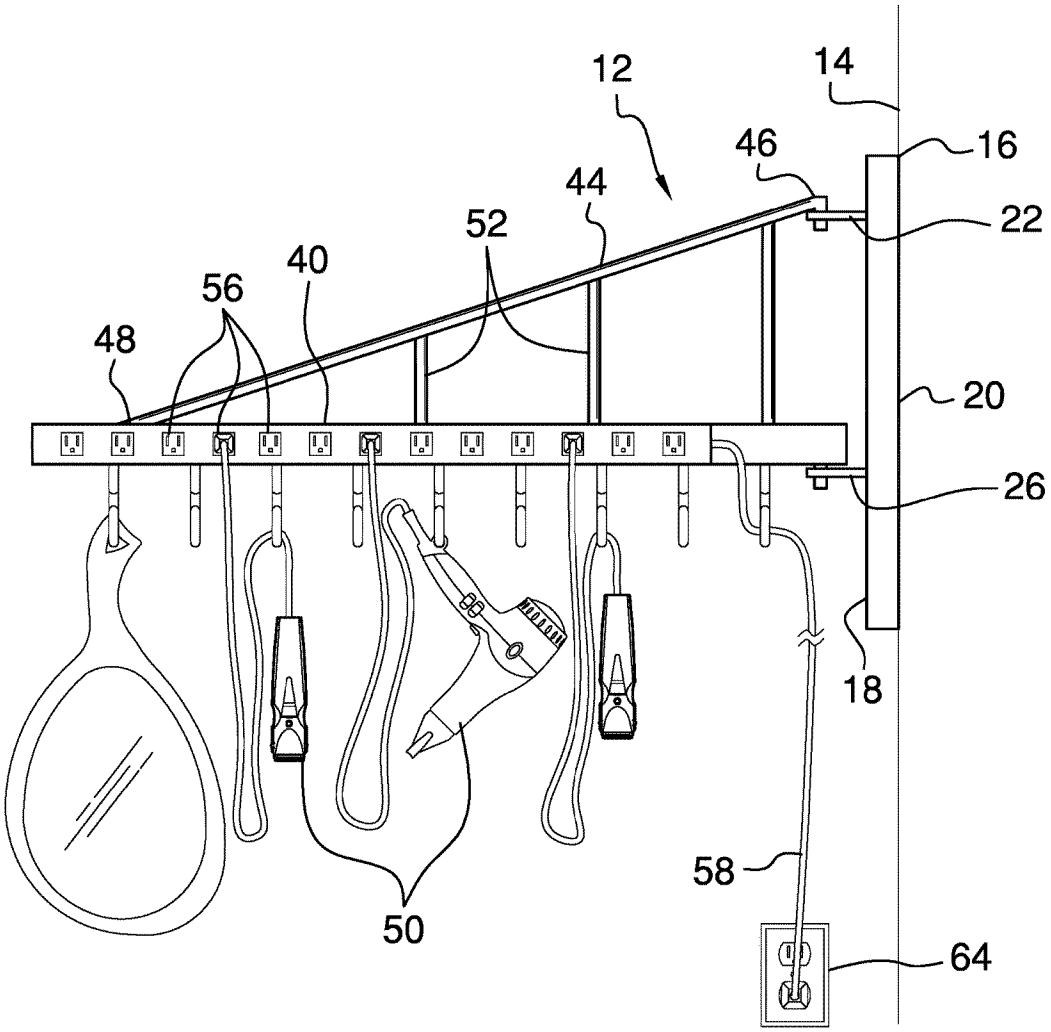
FIG. 3 is a perspective in-use view of an embodiment of the disclosure.
Figure 4:
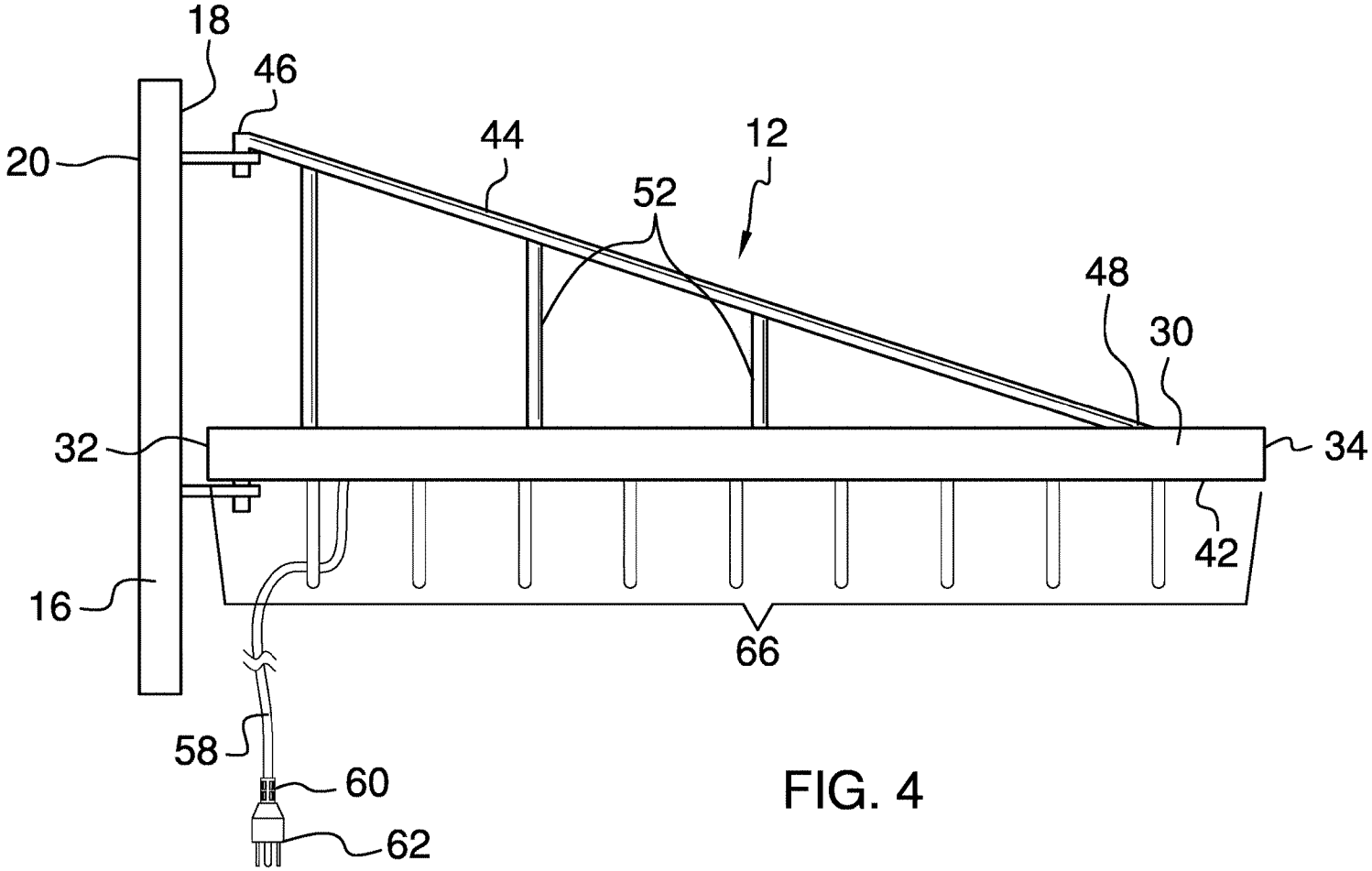
FIG. 4 is a left side view of an embodiment of the disclosure.

With reference now to the drawings, and in particular to FIGS. 1 through 4 thereof, a new storage device embodying the principles and concepts of an embodiment of the disclosure and generally designated by the reference numeral 10 will be described.

As best illustrated in FIGS. 1 through 4, the cosmetology tool storage assembly 10 generally comprises a gate 12 that is pivotally coupled to a vertical support surface 14 in a salon or the like. Thus, the gate 12 is accessible to a cosmetologist working in the salon. The salon may be a barber shop, a men's salon, a women's salon and any other location that provides cosmetology services. The gate 12 comprises a member 16 that has a front surface 18 and a back surface 20, and the back surface 20 is coupled to the vertical support surface 14 having the member 16 being vertically oriented.

An upper tab 22 is coupled to and extends away from the front surface 18 of the member 16. The upper tab 22 may have a first aperture extending therethrough. A lower tab 26 is coupled to and extends away from the front surface 18 of the member 16. The lower tab 26 is spaced from the upper tab 22 on the member 16 and the lower tab 26 may have a second aperture extending therethrough.

A rail 30 is provided that has a first end 32, a second end 34 and an outer surface 36 extending therebetween. The outer surface 36 has a front side 38, a top side 40 and a bottom side 42 and the rail 30 may have a length ranging between approximately 60.0 cm and 90.0 cm. The first end 32 of the rail 30 pivotally engages the lower tab 26 having the rail 30 being horizontally oriented. In this way the rail 30 is positionable at a plurality of angles with respect to the member 16. A first pin or the like may extend downwardly from the bottom side 42 of the rail 30 and the first pin may engage the first aperture in the lower tab 26. Alternatively, the rail 30 may pivotally engage the lower tab 26 through any mechanical means.

An arm 44 is included that has a first end 46 and a second end 48, and the first end 46 of the arm 44 pivotally engages the upper tab 22 on the member 16. The second end 48 of the arm 44 is coupled to the top side 40 of the outer surface 36 of the rail 30 having the arm 44 being oriented at a downward angle between the upper tab 22 and the rail 30. In this way the arm 44 assists the rail 30 to support weight of cosmetology tools 50. A second pin may be coupled to and extend downwardly from the arm 44 and the second pin may engage the second aperture 28 in the upper tab 22. Alternatively, the arm 44 may pivotally engage the upper tab 22 through any mechanical means. A plurality of supports 52 is each coupled between the arm 44 and the top side 40 of the outer surface 36 of the rail 30 thereby enhancing load bearing limits of the arm 44.

A power strip 54 is coupled to the front side 38 of the rail 30 and the power strip 54 has a plurality of female electrical outlets 56 positioned thereon. The plurality of female electrical outlets 56 is distributed along the power strip 54. A power cord 58 is coupled to and extends away from the power strip 54 and of the female electrical outlets 56 is electrically coupled to the power cord 58. The power cord 58 has a distal end 60 with respect to the power strip 54 and a plug 62 is electrically coupled to the distal end 60 for being electrically coupled to a power source 64, such as an electrical outlet in the salon.

A plurality of hooks 66 is included and each of the hooks 66 has a primary end 68 and a secondary end 70. The primary end 68 of each of the hooks 66 is coupled to the bottom side 42 of the power strip 54 and each of the hooks 66 is curved between the primary 68 and secondary 70 ends. Thus, the secondary end 70 of each of the hooks 66 is directed upwardly to engage and thusly suspend a respective one of a plurality of cosmetology tools 50 for storage. The cosmetology tools 50 may include, but not be limited to, electric clippers, electric hair dryers, hand mirrors and any other tools commonly employed by cosmetologists. Each of the hooks 66 is aligned with a respective one of the female electrical outlets 56 thereby facilitating the respective cosmetology tool 50 to be plugged in for power.

In use, the member 16 is mounted to the vertical support surface 14 having the member 16 being vertically oriented. In this way the rail 30 can be swung back and forth on the member 16. The plug 62 on the power cord 58 is plugged into the power source 64 and each of the cosmetology tools 50 is hung on a respective hook for storage. Additionally, the cosmetology tools 50 are plugged into a respective female electrical outlet on the power strip 54. In this way all of the cosmetology tools 50 may be stored and plugged into the respective female outlet thereby facilitating all of the cosmetology tools 50 to be immediately available for use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cosmetology tool storage assembly being configured to store and supply electrical power to a plurality of electrical cosmetology tools, said assembly comprising:

a gate being pivotally coupled to a vertical support surface wherein said gate is configured to be accessible to a cosmetologist, said gate comprising:

a member having a front surface and a back surface, said back surface being coupled to the vertical support surface having said member being vertically oriented;

an upper tab being coupled to and extending away from said front surface of said member;

a lower tab being coupled to and extending away from said front surface of said member, said lower tab being spaced from said upper tab on said member;

a rail having a first end, a second end and an outer surface extending therebetween, said outer surface having a front side, a top side and a bottom side, said first end of said rail pivotally engaging said lower tab having said rail being horizontally oriented, said rail being positionable at a plurality of angles with respect to said member;

an arm having a first end and a second end, said first end of said arm pivotally engaging said upper tab on said member, said second end of said arm being coupled to said top side of said outer surface of said rail having said arm being oriented at a downward angle between said upper tab and said rail wherein said rail is configured to support the weight of the cosmetology tools; and a plurality of supports, each of said supports being coupled between said arm and said top side of said outer surface of said rail thereby enhancing load bearing limits of said arm;

a power strip being coupled to said front side of said rail, said power strip having a plurality of female electrical outlets being positioned thereon, said plurality of female outlets being distributed along said power strip;

a power cord being coupled to and extending away from said power strip, said power cord having each of said female electrical outlets being electrically coupled thereto, said power cord having a distal end with respect to said power strip, said distal end having a plug being electrically coupled thereto wherein said plug is configured to be electrically coupled to a power source; and a plurality of hooks, each of said hooks having a primary end and a secondary end, said primary end of each of said hooks being coupled to said bottom side of said power strip, each of said hooks being curved between said primary and secondary ends such that said secondary end of each of said hooks is directed upwardly wherein each of said hooks is configured to engage and thusly suspend a respective one of a plurality of cosmetology tools for storage, each of said hooks being aligned with a respective one of said female electrical outlets wherein each of said female electrical outlets is configured to have the respective cosmetology tool plugged therein for power.

* * * * *